United States Patent [19]

Rocka

[11] 3,939,795

[45] Feb. 24, 1976

[54] OUTBOARD MOTOR PROTECTIVE COVER

[76] Inventor: Arthur J. Rocka, Rte. 1, Box 276, Tomball, Tex.

[22] Filed: June 3, 1974

[21] Appl. No.: 475,864

[52] U.S. Cl. ..... 115/17; 115/34 R

[51] Int. Cl.[2] ..... B63H 21/26

[58] Field of Search ..... 115/17, 42, 34 R, .5 R; 114/222

[56] References Cited

UNITED STATES PATENTS

| | | | |
|---|---|---|---|
| 2,089,366 | 8/1937 | Hansen | 115/17 |
| 2,244,217 | 6/1941 | Pries | 115/42 |
| 2,822,183 | 2/1958 | Montgomery | 115/17 |
| 3,151,597 | 10/1964 | Larsen | 115/34 R |
| 3,220,374 | 11/1965 | Sloan | 115/.5 R |
| 3,240,180 | 3/1966 | Byrd | 115/.5 R |
| 3,350,879 | 11/1967 | Boda et al. | 115/.5 R |

*Primary Examiner*—Trygve M. Blix
*Assistant Examiner*—Edward R. Kazenske
*Attorney, Agent, or Firm*—Pravel & Wilson

[57] ABSTRACT

A new and improved protective cover for the lower portion of an outboard motor including the skeg, rudder and propeller shaft housing to increase the strength of the motor parts covered and protect such parts against water damage and wear. A reinforcing rib may be added for additional strength and an insert plate may be inserted in the cover to replace a missing skeg.

7 Claims, 3 Drawing Figures

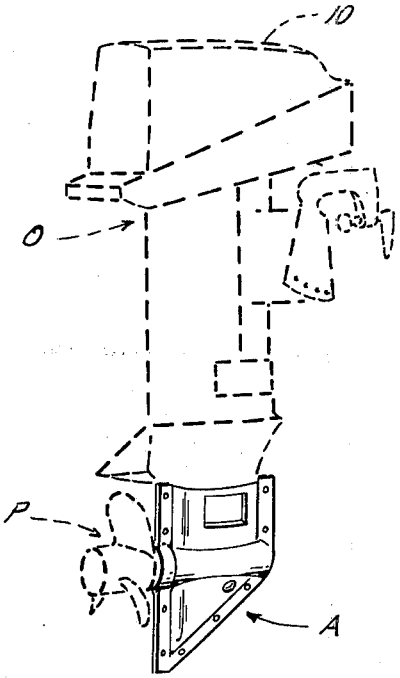
Fig. 1
Fig. 2
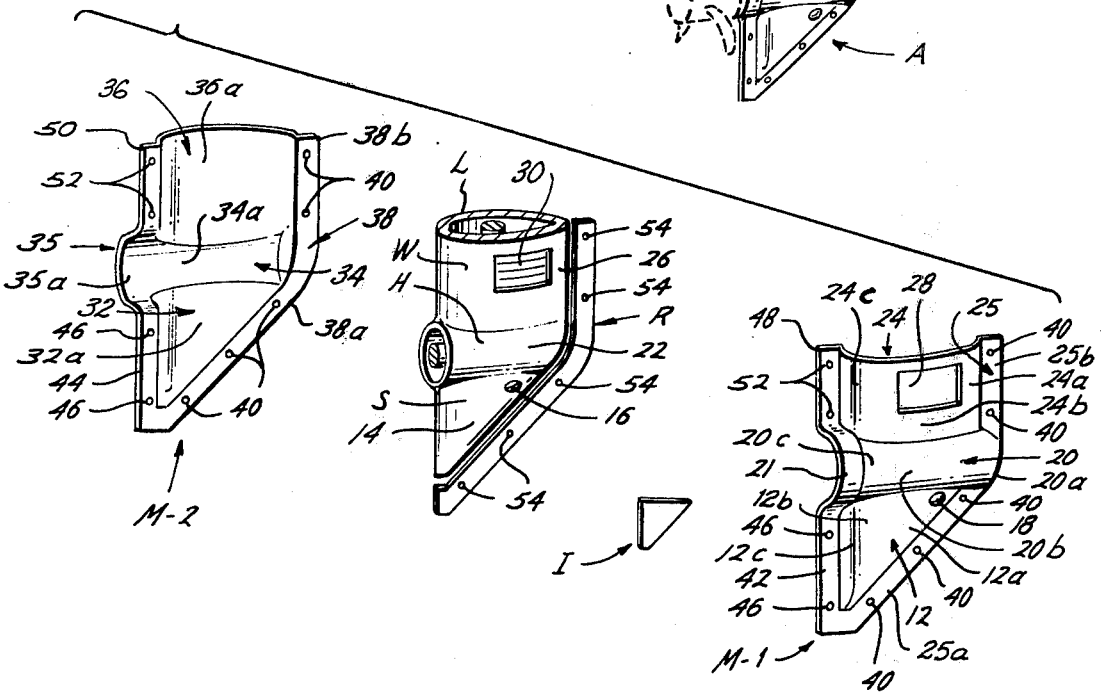
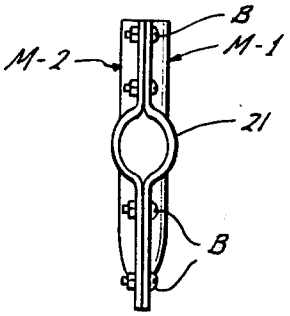
Fig. 3

OUTBOARD MOTOR PROTECTIVE COVER

BACKGROUND OF THE INVENTION

1. Field of the Invention

The present invention relates to protective covers for outboard motors.

2. Description of Prior Art

As is known, outboard motors typically extend into the water below the hull of the boat or other vessel driven by such motor.

When the boat was moving in shallow water or in the vicinity of submerged objects or material, the lower portions of the motor, particularly the skeg and the housing for the propeller shaft at the lower portion of the motor were often damaged. For example, the skeg would be broken off, dented or otherwise damaged, or the propeller shaft housing would be dented or damaged, sometimes to a degree sufficient to impair motor operation.

Further, the aluminum external surfaces of the lower portions of the outboard motor were often eroded away by sand and corrosive substances, particularly in salt water.

SUMMARY OF THE PRESENT INVENTION

Briefly, the present invention provides a new and improved protective cover apparatus for protecting an outboard motor having a first cover member means for covering a first portion of the motor, a second cover member means for covering a second portion of the motor and coupling means for connecting the first and second cover member means together to enclose the covered portions of the outboard motor therein.

The first cover member means and second cover member means are mounted on opposite sides of, and enclose portions of the outboard motor therebetween. Lower cover portions of the cover members enclose and cover the skeg of the motor, intermediate cover portions of the cover members enclose and cover the propeller shaft housing of the motor, and upper cover portions of the cover members enclose and cover the cooling water inlet housing of the motors, suitable openings are formed in the cover members to permit passage of cooling water into the cooling water inlet and to provide access to the oil filler plug of the motor.

An insert plate may be inserted and mounted between the first and second cover member means to replace a missing skeg on the motor, where desired. A reinforcing rib may be mounted between the first and second cover member means for additional strength. The first and second cover member means are formed in substantial conformity to the portions of the outboard motor covered thereby for unimpaired hydrodynamic flow characteristics for the motor.

It is an object of the present invention to provide a new and improved protective cover apparatus for an outboard motor.

BRIEF DESCRIPTION OF THE DRAWINGS

FIG. 1 is an isometric view, partly in phantom, of the apparatus of the present invention mounted with an outboard motor;

FIG. 2 is an exploded isometric view of the apparatus of FIG. 1; and

FIG. 3 is an elevation view of the apparatus of FIGS. 1 and 2.

DESCRIPTION OF THE PREFERRED EMBODIMENT

In the drawings, the letter A designates generally the apparatus of the present invention for protecting an outboard motor O (shown in phantom in FIG. 1). The outboard motor O may be any conventional, commercially available outboard motor such as, for example, the type sold by the Johnson Outboard Division, Outboard Marine Corp. of Waukegan, Ill. It should be understood, however, that the apparatus A of the present invention is adapted for use and may be used with other makes and models of outboard motors as well.

Since the outboard motor O is conventional, only those features thereof relevant to an understanding of the present invention will be referred to herein. As is conventional, the outboard motor O includes a propeller P driven by an internal combustion engine mounted within a cowl 10. The propeller P is driven by a propeller drive shaft mounted within a generally tubular horizontal propeller shaft housing H (FIG. 2). A conventional, triangular, rearwardly tapered propeller skeg S of the outboard motor O is mounted below the propeller shaft housing H, while a cooling water inlet housing W is mounted above the propeller shaft housing H between the housing H and an anti-slip plate L.

Considering the apparatus A more in detail, a first cover member M-1 and a second cover member M-2 are mounted with the outboard motor O to enclose and cover the propeller skeg S, the propeller shaft housing H and the cooling water inlet housing W. The first cover member M-1 and the second cover member M-2 are mounted on opposite side surfaces of the skeg S and housings H and W being covered.

The first cover member M-1 includes a lower cover portion 12 of a configuration substantially conforming to the external surface configuration of a side surface 14 of the skeg S, tapering outwardly from a front or leading edge 12*a* to a central portion 12*b* and tapering inwardly to a rear or trailing edge 2*c*. Where the outboard motor O is of the type having an oil filler plug 16 formed on the side surface 14 of the skeg S, an opening 18 is formed in the lower cover portion 12 adjacent the oil filler plug 16 to provide access thereto. On outboard motors having oil filler plugs located elsewhere within the surfaces covered by either of the cover members M-1 and M-2, an opening is formed in the cover M-1 or M-2, as the case may be, adjacent the oil filler plug to provide access to such plug.

An intermediate cover portion 20 of the first cover member M-1 is of a generally tubular configuration substantially conforming to the external surface configuration of a curved side surface 22 of the propeller shaft housing H. The cover portion 20 has a tapered nose or prow portion 20*a*, a tubular body portion 20*b* and a semicircular rear collar 20*c* adjacent an opening 21 for passage of the shaft of the propeller P therethrough.

The first collar member M-1 further includes an upper cover portion 24 of a configuration substantially conforming to an external surface 26 of the cooling water inlet housing W of the motor O. The upper cover portion 24 tapers outwardly from a front or leading surface 24*a* through a central portion 24*b* and tapers therefrom inwardly to a rear or trailing edge portion 24*c*. An opening 28 is formed in the upper cover portion 24 adjacent a cooling water inlet 30 of the cooling water inlet housing W to permit water to pass through the cover member M-1 into the cooling water inlet 30 to be used in the motor O for cooling purposes. It should be understood that on outboard motors having cooling water inlets located elsewhere within the surfaces covered by the cover members M-1 and M-2, an opening is formed in the cover member M-1 or M-2, as the case may be, adjacent such cooling water inlet to permit water to enter therein.

The second cover member M-2 includes a lower cover portion 32, an intermediate cover portion 34 having a collar 35 and an upper cover portion 36, whose inner surfaces 32*a*, 34*a*, 35*a* and 36*a*, respectively, are shown in FIG. 2. The lower cover portion 32, intermediate cover portion 34 and upper cover portion 36 are of a configuration substantially conforming to the configuration of the portions of the outboard motor O covered thereby, namely a side surface of the skeg S opposite the surface 16 thereof, a side surface of the tubular propeller shaft housing H opposite the surface 22 thereof, and a side surface of a cooling water inlet housing W opposite the surface 26 thereof, respectively. The external surfaces of the cover portions 32, 34 and 36 of the cover member M-2 are of like configuration to the corresponding cover portions of the cover member M-1.

Front mounting flange members 25 and 38 on the cover members M-1 and M-2, respectively, are formed extending forwardly from the leading surfaces of the cover portions of such cover members. Suitable openings 40 are formed in the mounting flange members 25 and 38 along lower segments 25*a* and 38*a* thereof and along upper segments 25*b* and 38*b* thereof so that coupling or connecting bolts B or other suitable connecting means may be inserted therethrough to connect the front or leading portions of the cover members M-1 and M-2 together.

Rear lower mounting flanges 42 and 44 are formed extending rearwardly from the lower cover portions 12 and 32, respectively, with suitable openings 46 formed therein for bolts or other suitable connecting means to be inserted therethrough to connect lower rear portions of the cover members M-1 and M-2 to each other. Rear upper mounting flanges 48 and 50 are formed extending rearwardly from rear surfaces of the upper cover portions 24 and 36, respectively, with suitable openings 52 formed therein for insertion of bolts or other suitable connecting means therethrough to connect the upper rear portions of the cover members M-1 and M-2 to each other.

The external surfaces of the cover members M-1 and M-2 are preferably formed having a stainless steel or other suitable material thereon for wear and corrosion resistance purposes.

A reinforcing rib R of like configuration to the front mounting flange members 25 and 38, and having opening 54 formed therein for passage of the connecting bolts B therethrough may be mounted between the cover members M-1 and M-2 at a position leading the covered portions of the outboard motor O for strengthening the cover members M-1 and M-2 and to further protect the portions of the motor O covered thereby.

When the skeg S of the outboard motor O has been broken or damaged, an insert plate I preferably of like configuration to the missing portion of the skeg may be inserted between the lower cover portions 12 and 32 and held in place therebetween when the cover members M-1 and M-2 are connected together. When so mounted, the insert plate I serves as a replacement for the broken or damaged skeg S. The insert plate I may also be a flat metal plate, if desired.

In the operation of the present invention, the cover members M-1 and M-2 of the apparatus A are assembled onto the lower portion of the outboard motor O and connecting bolts B inserted through the openings in the mounting flange members of the cover members M-1 and M-2. When the cover members M-1 and M-2 are connected together in this manner, they enclose covered portions of the outboard motor O, protecting the portions of the motor O so covered and increasing the strength of the parts so covered. Further, with the cover members M-1 and M-2 of a configuration in substantial conformity to the portions of the outboard motor O covered thereby, the hydrodynamic flow characteristics of the motor O through the water are substantially unimpaired. Accordingly, the apparatus A does not appreciably impair or detract from the operating and handling characteristics of the outboard motor O in the water.

Although in the preferred embodiment the connecting bolts B are the preferred means for connecting the cover members M-1 and M-2 together, it should be understood that welding, gluing or other suitable connecting means may be used as well. Further, it should be understood that sealing gaskets may be mounted between the mounting flanges on the cover members M-1 and M-2 if desired. Also, sealing gaskets may be mounted adjacent the openings formed in the apparatus A for the cooling water inlet 30 and oil filler plug 16, if desired.

The foregoing disclosure and description of the invention are illustrative and explanatory thereof, and various changes in the size, shape and materials as well as in the details of the illustrated construction may be made without departing from the spirit of the invention.

I claim:

1. An apparatus for protecting an outboard motor, which motor includes a skeg, a propeller shaft housing for a propeller shaft and a propeller, comprising:

a. first cover member means for enclosing and covering a first portion of the outboard motor;

b. second cover member means for enclosing and covering a second portion of the outboard motor;

c. said first and second cover member means enclosing and covering the skeg and propeller shaft housing of the motor and each having a recess formed therein for passage of the propeller shaft for connection with the propeller, said first and second member means each comprising:

1. a lower cover portion for enclosing and covering the skeg; and
2. an intermediate cover portion for enclosing and covering the propeller shaft housing;
3. a rear collar formed on said intermediate cover portion adjacent said recess for forming an opening for passage of the propeller shaft therethrough wherein the propeller is external of said first and second cover member means;

d. said first and second cover member means being formed from a solid member and in substantial conformity to the portions of the outboard motor enclosed and covered thereby for reducing impairment of the hydrodynamic flow characteristics of the outboard motor; and e. coupling means for connecting said first cover member means and said second cover member means together to enclose the covered portions of the outboard motor therein.

2. The structure of claim 1, wherein the skeg and propeller shaft housing of the outboard motor are formed at a lower end of cooling water inlet housing of the outboard motor and wherein each of said first and second cover member means comprises:

an upper cover portion for covering the cooling water inlet housing.

3. The structure of claim 2, wherein at least one of said upper cover portion comprises:

an upper cover plate having an opening formed therein adjacent the cooling water inlet for passage of water to the motor through said upper cover body.

4. The structure of claim 1, wherein at least one of said lower cover portions comprises:

a lower cover plate having an opening formed therein adjacent an oil filler plug formed in the skeg to provide access to the oil filler plug.

5. The structure of claim 1, wherein the skeg of the motor has been damaged and is missing and further including:

insert plate means mounted between said first and second cover member means for replacing the missing skeg on the motor.

6. The structure of claim 1, further including:

reinforcing rib means mounted between said first and second cover member means at a position leading the covered portions of the motor for strengthening said first and second cover member means.

7. The apparatus of claim 1, wherein:

each of said first cover member means and said second cover member means are formed having a stainless steel external surface for wear resistance.

* * * * *